United States Patent [19]

Basler et al.

[11] 4,262,182

[45] Apr. 14, 1981

[54] FULLY ILLUMINATED BACKLIT MEMBRANE TOUCH SWITCH

[75] Inventors: Peter H. Basler, Sussex; Gregory D. Schwehr, Milwaukee, both of Wis.

[73] Assignee: General Electric Company, Schenectady, N.Y.

[21] Appl. No.: 111,156

[22] Filed: Jan. 11, 1980

[51] Int. Cl.[3] ..... H01H 9/16; H01H 13/26

[52] U.S. Cl. ..... 200/314; 200/159 B

[58] Field of Search ..... 200/5 A, 159 B, 310, 200/314, 317, 311

[56] References Cited

U.S. PATENT DOCUMENTS

| | | | |
|---|---|---|---|
| 1,823,319 | 9/1931 | Dickinson | 200/314 |
| 3,184,569 | 5/1965 | McLaren | 200/317 |
| 3,584,162 | 6/1971 | Krakinowski | 200/159 B |
| 3,766,350 | 10/1973 | Van Dyk et al. | 200/159 R |
| 3,811,025 | 5/1974 | Bach | 200/159 B |
| 3,819,895 | 6/1974 | Pittman et al. | 200/159 B |
| 3,978,297 | 8/1976 | Lynn et al. | 200/159 B |
| 4,056,701 | 11/1977 | Weber | 200/314 |
| 4,088,855 | 5/1978 | Emery | 200/314 |

*Primary Examiner*—John W. Shepperd

[57] ABSTRACT

A printed wire board has lamp socket holes and switch contact pairs adjacent the holes on the top surface of the board and lamp socket contacts adjacent the holes on its bottom surface. An insulating spacer sheet is adhered to the board and has apertures which are congruent with the switch contact pairs. A membrane, adhered to the top surface of the spacer, has lamp holes and short circuiting contacts on its bottom surface for being flexed through the apertures to bridge gaps between the contact pairs on the board. An apertured rigid plate is superposed over and spaced from the membrane. Combination light channel and switch operating plunger elements fit in the plate apertures and contact the membrane. A film on which switch operating touch zones are delineated is adhered to the plate.

5 Claims, 8 Drawing Figures

FULLY ILLUMINATED BACKLIT MEMBRANE TOUCH SWITCH

This disclosure pertains to improvements in backlit membrane touch switch panels.

Membrane touch switches have been used as an alternative to conventional momentary contact push button switches. Membrane switches comprise first and second insulating films facing each other with a perforated third insulating spacer film between them. On the first film or membrane, in line with a perforation in the third film, a solid light impervious ring of metal foil or conductive material such as a silver composition is etched or printed to serve as one switch contact. In line with the same perforation, another ring of conductive material is printed on the second film to serve as the second open-centered switch contact. When the top of the first film or membrane is pressed slightly to apply pressure to a switch contact ring on it, this ring deflects through the perforation in the spacer and retracts so as to make momentary electrical contact with a contact on the underlying second film, thereby closing an electric circuit. The conductors, which are customarily conductive ink or thin foils, leading to the contacts on each film are isolated from each other by the third or intermediate perforated sheet. The laminated switch assembly is self-restoring to an open state as a result of the inherent resiliency of the membrane. Usually there is a plastic sheet superimposed over the first or top insulating film. This plastic sheet is opaque except in square or rectangular touch zones. Various graphics may be printed on the underside of the top sheet. It is common practice to illuminate the backside of the touch zones so the graphics can be easily read. This is done with a plurality of light sources such as incandescent lamps or light emitting diodes which are aligned, respectively, with the film perforations, the contact ring holes and the translucent touch zones.

One of the problems with prior art membrane touch switches is that the opaque conductive coating used for the open-centered switch contacts must lie within the boundaries of the film perforations and, hence, within the boundaries of the touch zones. Since the contacts shadow a part of the touch zone, illumination of the entire zone and all of the graphics within its boundaries is prohibited. One unsatisfactory solution to this problem would be to make the touch zones much larger so the graphics could be accommodated within the boundaries of the also necessarily enlarged open-centered contacts. This is not a practical thing to do, however, because it reduces the number of touch switches that can be arranged on a given panel.

Another disadvantage of prior art backlit membrane touch switches is that they require the lamps to extend into holes in a shield or block and these holes must be aligned with the perforations in the films, the purpose being to prevent light that is intended to be directed to one touch zone from crossing over and illuminating another touch zone which is not intended to be illuminated.

SUMMARY OF THE INVENTION

One of the objects of the present invention is to simplify construction of backlit membrane touch switches.

Another important object is to provide a backlit membrane touch switch panel which permits illuminating the entire touch zone and all of the graphics on it.

Still another object of the invention is to obtain uniform illumination of the touch zone.

Briefly stated, the new membrane touch switch panel is constructed on a printed wire board or substrate which has holes through it corresponding in number with the number of switches desired in the panel. Lamp sockets extend from the bottom side of the board through its holes and interlock with it. Contacts and leads for supplying the lamps are printed on the bottom of the board adjacent the holes. For each touch switch, a pair of contact areas with a gap between them are printed on the top of the board in the vicinity of the holes so that when the gap is bridged by an interfacing short circuiting contact, an electric circuit will be completed. Leads to the contacts may be printed on the top of the board and these leads may go to the backside through suitable printed pads and holes.

A first insulating film is adhered to the top surface of the board. This film has windows or apertures which are about the same size as the contact pairs on the board. A second insulating film or flexible membrane is adhered to the top of the first film. It has holes for the lamps to extend through and on its bottom side it has metalized areas which serve as short circuiting contacts surrounding the holes. The second film or membrane is sufficiently flexible to deflect through an aperture to allow a bottom contact area to close or bridge the gap between pairs of contacts on the top surface of the board to thereby complete the electric circuit.

A rigid plate is superimposed over the flexible membrane and is held in spaced relationship to the membrane with rigid spacers. This plate also has an aperture for each switch position. Hollow or tubular elements having open bottoms fit into these apertures and rest on the top surface of the second flexible membrane. These elements have two functions. One is to act as a switch plunger and the other is to act as a light conducting and shielding channel. Translucent light diffuser caps fit into the top openings of the channel elements. A flexible membrane that is mostly opaque, except for touch switch zones which are matted and translucent, has its bottom surface adhered to the top of the rigid plate. Graphics for identifying the function of the touch switches are printed on the bottom surfaces of these zones. When a zone is touched lightly, force is transmitted to the dual-function plunger and light channeling element which deflects the membrane that has the contacts on its bottom surface through the apertures in the second insulating membrane to thereby bridge the gap or short circuit the contact pairs which are on top of the circuit board.

The manner in which the aforementioned objects and other more specific objects of the invention are achieved will be evident in the more detailed description of a preferred embodiment of the invention which will now be set forth in reference to the drawings.

DESCRIPTION OF A PREFERRED EMBODIMENT

Figure 1:
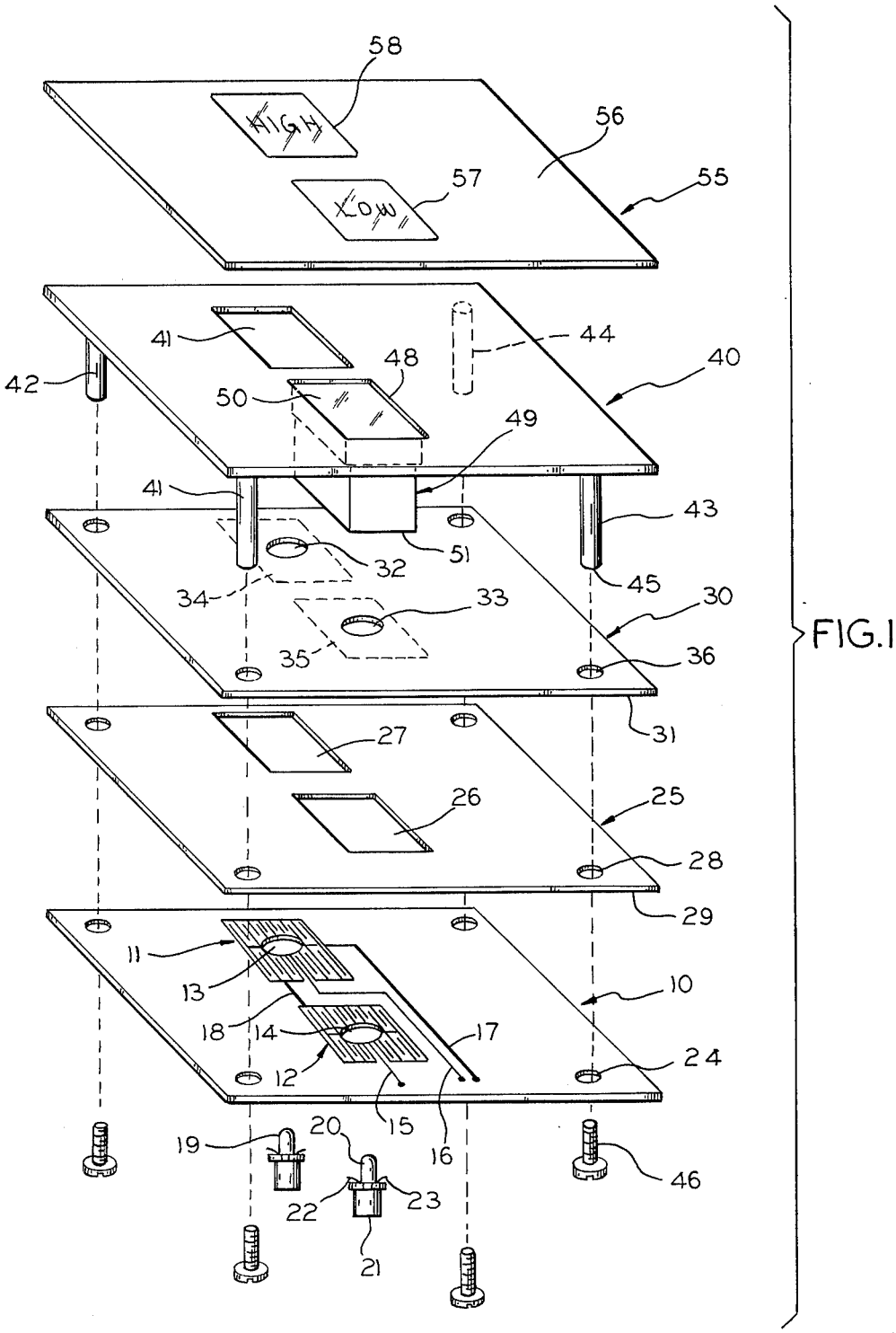
FIG. 1 is an exploded view of a backlit membrane touch switch panel constructed in accordance with the invention.

Referring to the FIG. 1 exploded view, the new backlit membrane touch switch assembly comprises a double-sided printed wire board 10 which may be looked upon as the base or substrate on which the touch switch panel is constructed. On the nominally top side of board 10 in this illustrative embodiment there are two sets of contacts 11 and 12 which surround holes 13 and 14 in the board. Each set of contacts is essentially a pair of contacts with a gap between them. Conductive leads 15, 16 and 17 run to the contacts. Lead 17 is a common conductor. One-half of each contact 11 and 12 is connected in the common return circuit with a lead 18. Contacts 11 and 12 may be formed in various ways. For instance, they may be formed by silk screening a conductive ink on the top surface of the printed wire board 10 or they can be etched from a copper foil or they could be adhesive metal foils which are typical of printed wire board construction. Lamp socket holes 13 and 14 are provided for permitting lamps such as those marked 19 and 20 to extend through insulating board 10. The term "lamp" is used herein as generic to incandescent lamps, light emitting diodes and any other suitable light source. Typical lamp 19 is in a socket 21 which has electrical spring contacts 22 and 23 which make contact on the bottom of board 10. The sockets are adapted to interlock in board 10 as will be explained later. The board has four holes in its corner such as the one marked 24. By way of example and not limitation, the thickness of rigid insulating board 10 in a commercial embodiment is about 0.06 of an inch.

A film or sheet constituting an insulating spacer 25 having a self-adhesive coating on its bottom surface 29 is superposed on board 10. Spacer 25 may be a sheet of polyester or other suitable resin. Spacer sheet 25 has a pair of rectangular apertures 26 and 27 which have about the same size and shape as the thin pairs of contacts in contact sets 11 and 12 on board 10. Apertures 26 and 27 are located congruently or in alignment with contacts 11 and 12. Spacer sheet 25 has holes in its four corners such as the hole marked 28. By way of example, spacer sheet 25 is typically about 0.005 of an inch thick in one commercial embodiment.

Superimposed on spacer sheet 25 is a flexible membrane 30. By way of example, this membrane may be about 0.005 of an inch thick and is desirably made of polyester resin, for example. Membrane 30 also has an adhesive coating on its bottom surface 31 for adhering it to the top surface of spacer sheet 25. Membrane 30 is illustrated as having a pair of holes 32 and 33 which are congruent with lamp socket holes 13 and 14 in the printed wire board substrate 10. There are a pair of thin uninterrupted contact areas 34 and 35 formed on the bottom surface of membrane 30. As indicated by the dashed lines, these contacts are rectangular in shape and have the same size as apertures 26 and 27 in the spacer sheet 25 to which apertures the contacts 34 and 35 are substantially congruent. Contacts 34 and 35 may be formed by painting or screening conductive ink on the bottom surface of the membrane or they may be metal foils which are adhered to the bottom surface. The exposed faces of contacts 34 and 35 have no adhesive on them, of course.

When flexible membrane 30, spacer 25 and wire board 10 are adhered together to form a three-layer laminated assembly, contacts 34 and 35 will be maintained in spaced relationship from contacts 11 and 12 on the printed wire board by spacer 25. Then, if a minor force is applied to the nominally top surface of membrane 30 within the area of its contacts 34 and 35, these contacts and the membrane will flex through apertures 26 and 27 and make electrical contact with a pair of contacts comprising printed wire board contact set 11 or 12 to bridge the gap between the pair and short circuit them to close an electric circuit. Membrane 30 also has four corner holes such as the one marked 36 which are aligned with holes 28 and 24 in the spacer 25 and wire board 10, respectively.

The next element in the panel structure is a preferably metal plate that is generally designated by the reference numeral 40. In a commercial embodiment, by way of example and not limitation, plate 40 is made of aluminum and is about 0.09 of an inch thick. Four standoff posts 41-44 are fastened to the bottom surface of plate 40. The lower ends of each post, such as the end 45 on post 43, have axially extending internally threaded holes in them for receiving the threaded shanks 46 of the four screws illustrated at the bottom region of FIG. 1.

Plate 40 is illustrated as having two rectangular apertures 47 and 48. The number of these apertures corresponds with the number of touch switches in any panel. One aperture 48 is shown as having a hollow tubular element 49 inserted in it. A similar element which would be inserted in aperture 47 has been omitted for the sake of clarity. Element 49 performs the multiple functions of acting as a light guiding and shielding channel and as a switch operating plunger. The top of element 49 has a translucent plastic cover 50 which serves as a light spreader or diffuser. The bottom end 51 of hollow element 49 is open and has essentially the same shape as solid contact areas 34 and 35 on the underside of membrane 30. It will be evident that if a vertical force is applied to the combination light channel and plunger element 49 a corresponding force will be applied to contact 35 on the membrane for flexing this contact through aperture 26 in spacer 25 to make contact with the pair of contacts in contact 12 set on the top surface of printed wire board 10. Aperture 47 in plate 40 would normally have a hollow element such as the one marked 49 inserted in it but the element has been omitted for the sake of clarity. The details of element 49 can be seen in FIG. 4 and will be discussed as soon as the next major component of the panel assembly is described in reference to FIG. 1

In FIG. 1, the top layer of the panel is a pliable resin film 55 which may be a few thousandths of an inch thick. The major area 56 of film 55 is opaque and the film has a matte finish to make it light diffusing in those light transmissive touch zones lying within the opaque area. Two touch zones 57 and 58 constituting switch positions are illustrated on top film 55. Some illustrative graphics consisting of the words low and high are printed within the light diffusing and transmissive touch zones 57 and 58. The graphics are printed on the bottom of film 55 so they will not wear off as a result of repeated touching of these switch operating zones. Zones 57 and 58 have substantially the same area and configuration as the apertures 47 and 48 in plate 40 and the opening through hollow element 49 so that the entire area of the zones will be illuminated when light is transmitted through the adapter and its diffuser 50 from lamps such as those marked 19 and 20. It will be evident that when a touch zone such as 57 is pressed, force will be transmitted to the diffuser cover 50 of hollow element 49 for deflecting the membrane contact 35 as described earlier.

Figure 4:
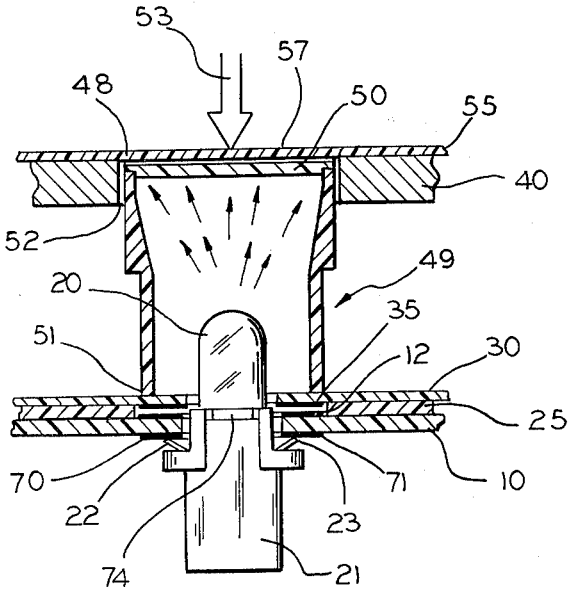
FIG. 4 is a section of one of the two touch switch assemblies shown in FIG. 3, said section being taken in a plane that parallels the plane of the drawing sheet in that figure.

The details of element 49 will now be examined in FIG. 4. Here the diffuser plate 50 is shown inserted in the top of hollow element 49 which, as has been indicated, serves as the switch actuating plunger and as a light channel or shield. A small clearance space 52 is provided around the margins of aperture 48 and the perimeter of the hollow element. Clearance space 52 is shown with exaggerated dimensions in FIG. 4. In an actual embodiment, there is a clearance of about 0.001 of an inch for the element in an aperture 48. The height of element 49 in combination with its diffuser cover 50 is just a little less than the space between the uppermost touch zone and graphic bearing film 55 and membrane 30. In FIG. 4 the touch force applied to touch zone 57 for actuating a switch is indicated by the arrow marked 53.

Figure 2:
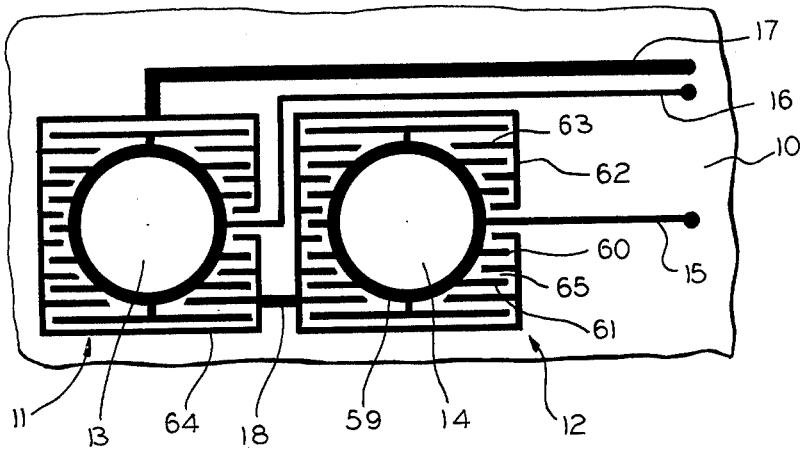
FIG. 2 is a plan view of some typical contacts which are fixed on the top of the printed wire board.

The details of the split contacts in sets 11 and 12 which are deposited on the top of printed wire board 10 will now be examined in FIG. 2. Typical stationary contact 12 will be described. It is basically a two-part contact. One part is a conductive ring 59 surrounding the lamp socket hole 14 in the wire board 10 and having a plurality of fingers such as the pair marked 60 and 61 extending from it. As indicated earlier, the ring and fingers may be formed with conductive ink or foil, for example. The ring and its fingers are connected to a lead 15 and constitute one part of the stationary contact 12. The other part is comprised of a perimetral strip 62 which has a plurality of fingers or strips 63 extending inwardly from it. These strips and peripheral band 62 constitute the other part of the stationary contact and lead to common conductor 17 to strip 18 and the perimetral band 64 of adjacent contact 11. The fingers extending from ring 59 in contact 12 and the fingers extending from the perimetral strip are interdigitated and separated by gaps such as the one marked 65. Because of the distribution of the fingers, there is absolute assurance that a short circuiting contact will be made between them by the continuous contact 35 on the bottom of membrane 30.

Figure 5:
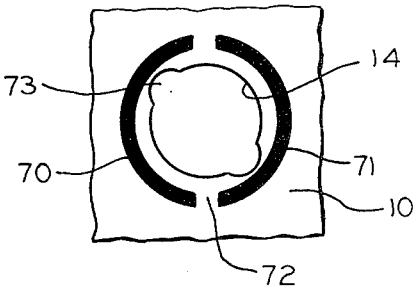
FIG. 5 is a plan view of a typical pair of contacts which are on the bottom of the substrate circuit board and are used for making electrical connections to the lamp sockets which illuminate the touch switches.

FIG. 4 also shows how the lamp sockets such as the one marked 21 and its lamp 20 are arranged in the assembly. As pointed out earlier, these commercially available lamp sockets have a plastic body and a pair of spring contact fingers 22 and 23 extending from them for making an electric circuit through the filament of the lamp or through a light emitting diode if one is used in place of the lamp. Socket contacts 22 and 23 make contact with a split ring contact whose two halves 70 and 71 are deposited or printed on the bottom surface of insulating board 10. A plan view of the socket contacts 70 and 71 is shown in FIG. 5 where one may see the gap 72 between contacts. Note in this enlarged view that hole 14 in board 10 has notches such as the one marked 73 which are diametrically opposite from each other. These notches are for providing a clear entry for a pair of tabs such as the one marked 74 on the socket depicted in FIG. 4. The sockets are inserted in bayonet fashion, that is, they are pushed through the holes 14 in the board while the tabs 74 are aligned with notches 73 and then the sockets are turned to dispose the tabs onto the topside of the board to thereby lock the sockets in place while at the same time compressing spring contacts 22 and 23 so they make good contact with the semicircular rings 70 and 71. Notice that the construction is such that the original lamps and burned out lamps can be easily installed and removed from the back of the board without requiring any other disassembly.

Figure 3:
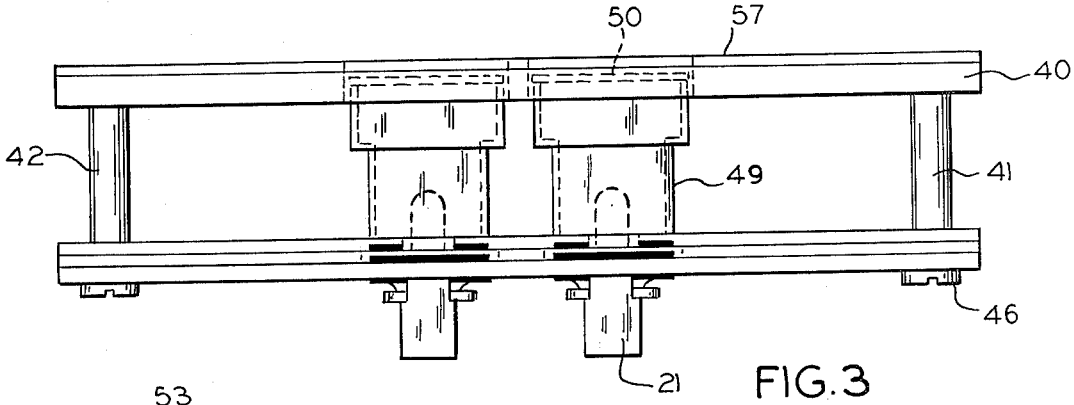
FIG. 3 is a side elevation view of a touch switch panel in assembled condition and ready for installation in a suitable switch panel housing.

FIG. 3 shows a completely assembled panel which, for the sake of brevity, uses only two touch switch assemblies. Obviously, these assemblies can be packed closely to each other to form a large panel. The assembly in FIG. 3 is well adapted to installations where invasion by fluids must be prohibited. The front or top touch surface 57 is completely imperforate so if the panel is installed in a window opening in a housing, not shown, it is only necessary to use adhesive or install a gasket, not shown, around the perimeter of the panel to obtain a fluid tight interface.

Figure 6:
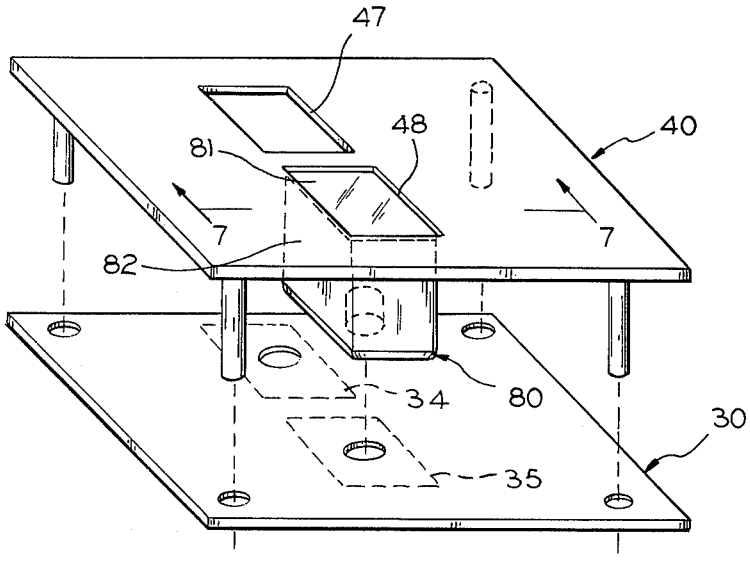
FIG. 6 is a partial exploded view of an alternative embodiment of the touch switch panel.
Figure 7:
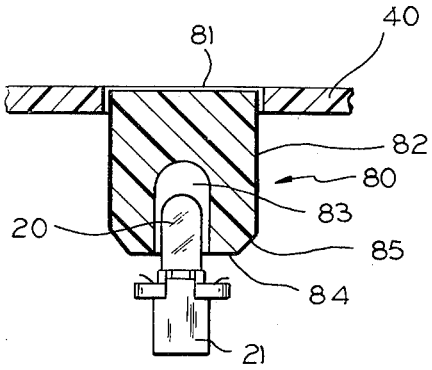
FIG. 7 is a section taken on a line corresponding with 7—7 in FIG. 6.

An alternate embodiment of the invention will now be discussed in reference to FIGS. 6 and 7. Parts which are similar to those shown in the previously discussed embodiment are given the same reference numerals. FIG. 6 shows the rigid support plate 40 and flexible membrane 30 isolated from the assembly in FIG. 1. The rigid plate 40 has the same apertures 47 and 48 as in FIG. 1 and membrane 30 has the pairs of uninterrupted contacts 34 and 35 on its bottom surface. The adapter or combination switch plunger and light channel in the FIG. 6 embodiment, however, differs from hollow element 49 in FIG. 1. In FIG. 6 the element is designated generally by the reference numeral 80. In this case element 80 is a prism of light transmitting plastic. The top surface 81 of the prism is matted for the purpose of diffusing light. The prism fits into an aperture 48 loosely as was the case with the hollow element 49 in the preferred embodiment. The outside surfaces or walls 82 of element 80 are blackened to prevent light crosstalk between switches. As can be seen in FIG. 7, the bottom surface 84 is also blackened. The prism is provided with a cavity 83 into which the lamp 20 projects. Light from the lamp is conducted through the prism to the top diffusing surface 81 and spreads out over the underside of the touch zone on top film 55 which has been omitted from FIG. 6. The bottom corners 85 are beveled.

It should be recognized that in both embodiments, as a result of the light diffusing means which are installed between the top of the touch zones and the light sources bright spots, which might otherwise be apparent in the touch zones as a result of the light originating from a concentrated point in the source, are eliminated.

Figure 8:
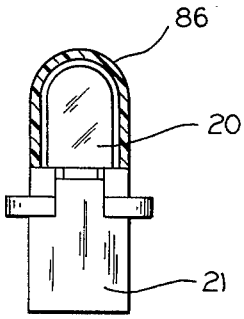
FIG. 8 shows a lamp socket and a lamp over which there is a colored translucent boot for enabling illuminating touch switch zones with variously colored lights if desired.

FIG. 8 shows how the touch zones may be illuminated with light of various colors. For this purpose, translucent commercially available boots such as the one marked 86 are slipped over the lamps 20.

Although a preferred embodiment of the invention has been described in considerable detail, such description is intended to be illustrative rather than limiting, for the invention may be variously embodied and is to be limited only by interpretation of the claims which follow.

We claim:

1. A backlit membrane touch switch panel comprising:

an insulating board having a hole for receiving a light source and having a pair of contacts with a gap between them disposed on the nominally top surface of said board adjacent said hole, a thin insulating spacer sheet arranged with its bottom surface facing said board, said spacer sheet having an aperture aligned with said contacts, an insulating flexible membrane having a hole aligned substantially with the hole in said board and arranged with its bottom surface facing the top surface of said spacer sheet, said membrane having a thin contact disposed on its bottom surface and aligned with said spacer aperture, said contact becoming engageable with said pair of contacts to bridge said gap when said membrane is pressed and flexed through said aperture, said membrane restoring to its unflexed condition when it is not pressed, a rigid plate member arranged with its bottom surface in substantial parallelism with said membrane and spaced from said membrane, said plate member having an aperture that aligns substantially with said aperture in said spacer sheet, means for maintaining said plate member at a fixed spacing from said membrane, a rigid combination switch plunger and light channel element having its nominally upper end loosely fit in said plate aperture and its lower end bearing on said membrane in the vicinity of the contact on its bottom, a film having its bottom surface interfaced with the top surface of said plate member and having a translucent zone disposed over said plunger and light channel element such that force produced by touching said zone will be transmitted by said element to flex said membrane and cause said contacts to engage, and a lamp and a socket for the lamp, said socket having exposed contacts extending from it and leading to said lamp, said socket having means for interlocking it with said board and said socket holding lamp for it to extend into said combination light channel and plunger element, said exposed socket contacts engaging respectively with said contacts on the bottom surface of the board when said socket is interlocked.

2. The touch switch panel as in claim 1 wherein:

said combination plunger and light channel element is a hollow element having a bottom end opening bearing on the nominally top surface of said membrane and having a top end opening extending into the aperture of said plate member, and a light diffuser disposed over one of said end openings.

3. The touch switch panel as in claim 1 wherein:

said combination plunger and light channel element is a prism of light conductive material having nominally bottom, top and side surfaces, said bottom surface bearing on the top surface of said membrane and said top surface extending into the aperture of said plate member, said side surfaces being opaque and said bottom surface having a cavity for receiving a light source.

4. The touch switch panel as in claim 1 wherein:

each contact in the pair of contacts on said top surface of said board comprises a plurality of thin conductive strips and the strips of one contact are interdigitated with the strips on the other but have insulating gaps between them.

5. The touch switch panel as in any of claims 1, 2, 3 or 4 including:

thin pairs of contacts with a gap between them disposed on the nominally bottom surface of said board and arranged adjacent said hole in said board.

* * * * *